United States Patent [19]

Chamberland

[11] Patent Number: 4,896,389

[45] Date of Patent: Jan. 30, 1990

[54] INFLATABLE AIR MATTRESS

[75] Inventor: Paul Chamberland, Pointe Claire, Canada

[73] Assignee: S.S.I. Medical Services of Canada Inc., Pointe Claire, Canada

[21] Appl. No.: 204,732

[22] Filed: Jun. 10, 1988

[51] Int. Cl.[4] ..... A47C 27/08

[52] U.S. Cl. ..... 5/453; 5/456; 5/449

[58] Field of Search ..... 128/33; 441/40, 41, 441/42, 66; 5/453, 455, 465, 449, 454, 456; 297/DIG. 3

[56] References Cited

U.S. PATENT DOCUMENTS

| | | | |
|---|---|---|---|
| 945,234 | 1/1910 | Hinsdale . | |
| 1,830,570 | 11/1931 | Smith et al. | 5/449 |
| 2,816,299 | 12/1957 | Holladay | 441/66 |
| 3,056,980 | 10/1962 | Holladay | 5/455 |
| 3,303,518 | 2/1967 | Ingram . | |
| 3,644,950 | 2/1972 | Lindsay, Jr. . | |
| 3,653,083 | 4/1972 | Lapidus . | |
| 3,672,354 | 6/1972 | Weber | 128/33 |
| 3,674,019 | 7/1972 | Grant . | |
| 3,678,520 | 7/1972 | Evans . | |
| 3,778,851 | 12/1973 | Howorth . | |
| 3,822,425 | 7/1974 | Scales . | |
| 3,879,776 | 4/1975 | Solen . | |
| 4,193,149 | 3/1980 | Welch . | |
| 4,224,706 | 9/1980 | Young et al. . | |
| 4,225,989 | 10/1980 | Corbett et al. . | |
| 4,297,755 | 11/1981 | Mollura . | |
| 4,346,489 | 8/1982 | McMullan . | |
| 4,394,784 | 7/1983 | Swenson et al. . | |
| 4,525,885 | 7/1985 | Hunt et al. . | |
| 4,542,547 | 9/1985 | Sato . | |
| 4,617,690 | 10/1986 | Grebe . | |
| 4,638,519 | 1/1987 | Hess . | |
| 4,644,597 | 2/1987 | Walker | 5/453 |
| 4,686,722 | 8/1987 | Swart . | |
| 4,694,520 | 9/1987 | Paul et al. | 5/455 |
| 4,745,647 | 5/1988 | Goodwin | 5/455 |

FOREIGN PATENT DOCUMENTS

| | | | |
|---|---|---|---|
| 101633 | 7/1937 | Australia | 441/66 |
| 608979 | 11/1960 | Canada | 5/453 |
| 841704 | 5/1939 | France | 5/455 |
| 1442492 | 5/1966 | France | 5/449 |
| 2373996 | 8/1978 | France | 5/456 |
| 1273342 | 5/1972 | United Kingdom . | |
| 1545806 | 5/1979 | United Kingdom . | |
| 2141333 | 12/1984 | United Kingdom | 5/453 |

*Primary Examiner*—Gary L. Smith
*Assistant Examiner*—Eric K. Nicholson
*Attorney, Agent, or Firm*—Foley & Lardner, Schwartz, Jeffery, Schwaab, Mack, Blumenthal & Evans

[57] ABSTRACT

Disclosed is a one-piece inflated air mattress that can be used as such or laid over a hospital bed mattress. Its body is formed of a series of transverse parallel pillow-like air tunnels connected at their ends with a pair of lengthwise distribution channels. The body has an inlet end, to which an air pressure source is connected, and a terminal end; the distribution channels running between the two ends and tapering from one end to the other, being wider at the inlet end than at the terminal end. An open-ended plenum conduit, located at the inlet end of the body, communicates at its ends respectively with said distribution channels.

8 Claims, 3 Drawing Sheets

INFLATABLE AIR MATTRESS

BACKGROUND OF THE INVENTION

1. Field of the invention

The present invention relates to an inflatable air mattress used to improve the comfort of patients that are immobilized over long periods of time. The mattress of the invention can be used as such or be placed over the mattress of a conventional hospital bed and it is independent from it.

2. Description of the prior art

For this type of patients, it is recommended to provide a mattress which is quite flexible throughout its length to prevent the creation of pressure points on parts of the patient's body that support its weight. These pressure points tend to cause occlusion of blood capillaries on the surface of the skin resulting in the development of body sores or skin rashes. The patent literature is replete with suggestions of mattress constructions intended to prevent this problem. While all of them seem to be based on the use of air inflatable mattresses, a very large number are more specifically adapting the principle of creating a ripple effect on the surface of the mattress, and consequently on the patient's body, to activate blood circulation. However, the known mattresses are quite complex in structure because of the presence of individual air circuits that are separately and alternatively supplied with pressure air and because of the complicated mechanical and electrical control system that is required to operate the mattress properly. These mattresses are consequently extremely costly.

Patents known to the present applicants and addressing this subject are as follows:

| | | | |
|---|---|---|---|
| | U. S. Pat. Nos. | | |
| 945,234 | Hinsdale | 3,303,518 | Ingram |
| 3,644,950 | Linsay | 3,653,083 | Lapidus |
| 3,674,019 | Grant | 3,678,520 | Evans |
| 3,778,851 | Howorth | 3,822,425 | Scales |
| 3,879,776 | Solen | 4,193,149 | Welch |
| 4,224,706 | Young et al | 4,225,989 | Corbett et al |
| 4,297,755 | Mollura | 4,346,489 | McMullan |
| 4,394,784 | Swenson et al | 4,525,885 | Hunt et al |
| 4,542,547 | Sato | 4,617,690 | Grebe |
| 4,638,519 | Hess | 4,686,722 | Swart |
| | U. K. Patents | | |
| 1,273,342 | Hopkins | 1,545,806 | Hopkins |

SUMMARY OF THE INVENTION

An object of the present invention is to provide an inflatable air mattress in which air can be moved throughout its inner cavity without hindrance, in the manner of communicating vases, so that a pressure created by a particular portion of the patient's body is immediately transmitted to the complete air mass, thereby avoiding the creation of pressure spots.

Another object is to provide a mattress having transverse air tunnel-like pillows supplied, at their ends, by lateral air distribution channels of which the cross-section decreases from the air inlet end to the terminal end of the mattress thereby providing uniform air pressure in all pillows regardless of their position with respect to the inlet end.

Still another object of the invention lies in the provision of an inflated mattress which is directly connected to an adjustably controllable air compressor thereby avoiding the use of costly valves and/or cyclic switches or the like.

Yet another object of the invention is that the ends of the pillows or air tunnels extend laterally outwardly of the lateral air distribution channels thereby making the patient's supporting surface wider than usual.

More specifically and basically, the invention is an inflatable air mattress in the form of a one-piece elongated body made of flexible plastic material or air-retentive fabric and comprising, in inflated condition:

a plurality of elongated parallel pillow-like straight air tunnels extending transversely of the body and disposed adjacent one another along essentially the full length of the body;

a pair of air distribution channels located alongside the body and extending over essentially the full length thereof; each air tunnel having open ends and communicating with the distribution channels at its open ends, respectively, in order to be supplied with inflation air from the channels;

wherein the body has an air inlet end and a terminal end away from the inlet end and wherein the distribution channels taper from the inlet end to the terminal end, having a cross-section that is larger at the inlet end that at the terminal end;

an open-ended transverse plenum conduit at the inlet end, the conduit opening into the distribution channels, whereby the channels, the air tunnels and the plenum conduit communicate with one another, and air pressure source means operatively connected to the transverse plenum conduit to supply the conduit, the channels and the tunnels with pressure air.

Advantageously, each air tunnel may be integrally formed with a small air pocket at each end, said pocket extending over and covering the adjacent distribution channel to increase the width of the mattress.

The above air pressure source means may advantageously comprise:

a pressure-adjustable compressor assembly, and an air inlet conduit having one end connected to the compressor assembly and another end connected to the plenum chamber; the air-inlet conduit being devoid of air-flow control devices.

As mentioned above, and more specifically expressed, at least a major portion of the air tunnels should extend over and laterally beyond the distribution channels.

Other features and advantages of the invention will be apparent from the description that follows, having reference to the appended drawings.

DESCRIPTION OF THE PREFERRED EMBODIMENT

The illustrated inflatable air mattress 1 is in the form of a one-piece elongated body 3 entirely made of flexible plastic material, preferably vinyl or an urethane coated nylon such as DERMOFLEX ® of an air-retentative fabric.

Figure 4:
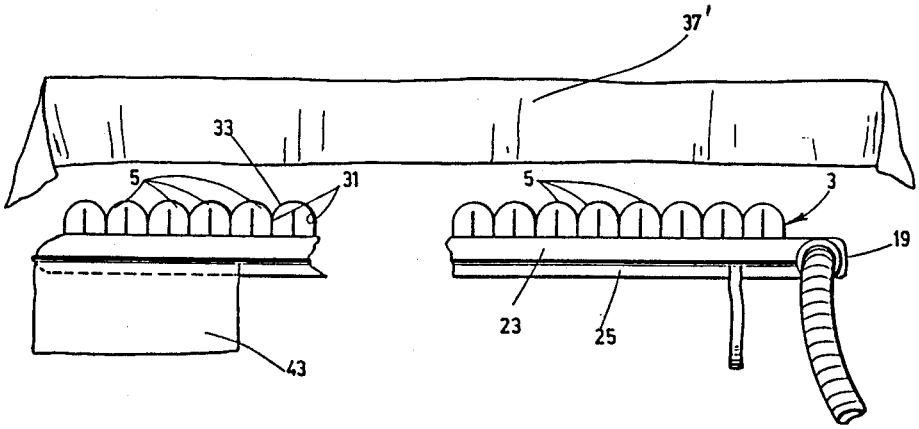
FIG. 4 is a longitudinal side elevation view.

The body 3 comprises, in inflated condition, a series of elongated parallel pillow-like straight air tunnels 5 that extend transversely of the body 1 and are disposed adjacent one another along essentially the full length of the body. In properly inflated condition, the tunnels 5 touch one another as best shown in FIG. 4. All obviously are of equal size and of constant cross-section.

Figure 2:
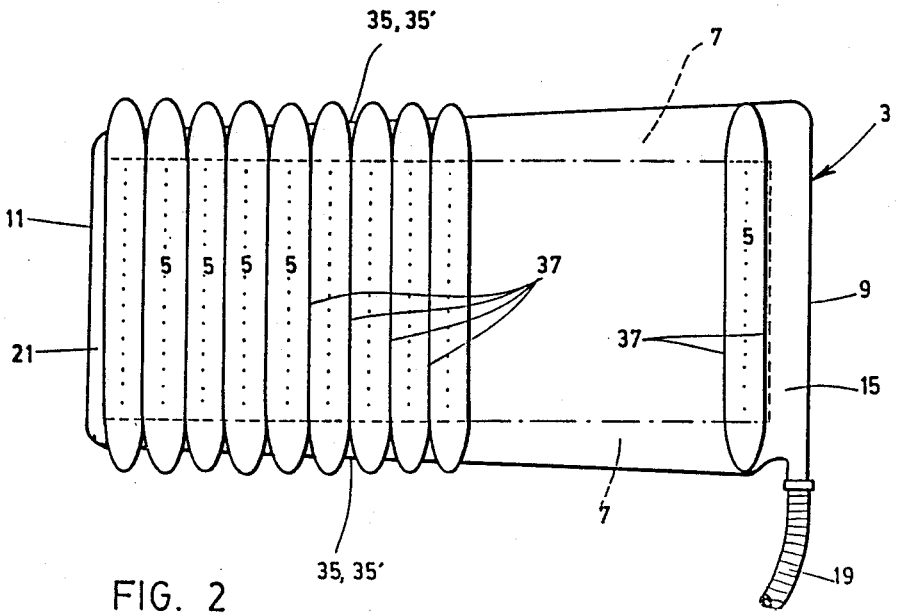
FIG. 2 is a top plan view of the mattress of FIG. 1.
Figure 3:
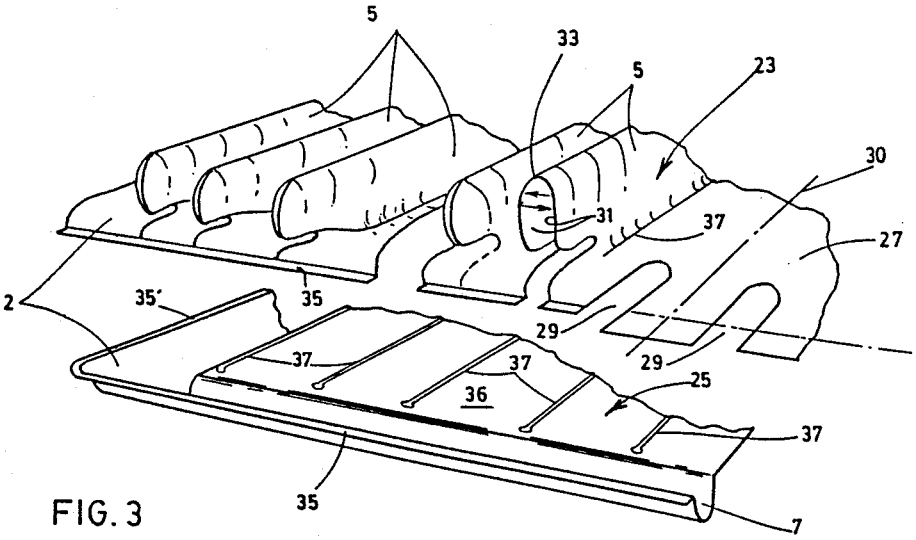
FIG. 3 is a perspective exploded view of part of the mattress; the upper section being shown in three different steps of its formation.

Tunnels 5 all communicate with air distribution channels 7 in order to be supplied with inflation air. Channels 7 extend the full length of the body 1, tapering from the air inlet end 9 of the body 3 to its terminal end 11, that is, having a greater cross-section at the inlet end 9 than at its terminal end 11, as seen in FIGS. 2 and 3. With the tunnels 5 opening directly into both channels 7, tapering of the latter ensures constant pressure throughout the mattress body 3 under the communicating vessels principle. Therefore, the above described structure allows all air pillows or tunnels 5 to be inflated at the same pressure regardless of their location with respect to the inlet end 9. Due to the excellent pressure distribution obtained with the tapering channels 7, the pressure output of the air supply unit, in this case the compressor 17, to keep the air tunnels 5 properly inflated to support a patient's body may be as low as 5.5" of water as compared to 8" to 14" in conventional systems.

The air distribution channels 7 are interconnected, at the inlet end 9, by a transverse plenum conduit 15. In this manner, the conduit 15, the channels 7 and the air tunnels 5 all communicate with one another to form a series of closed air circulation circuits.

The plenum conduit 15 is supplied with air under pressure by a pressure-adjustable compressor unit 17 connected to the plenum conduit 15 by a flexible hose 19. With this arrangement, the plenum conduit is in direct communication with the compressor 17 and no valve assembly and/or cyclic switches or the like need be used thereby appreciably reducing the total cost of the mattress assembly, as foresaid.

It will be appreciated that the hose 19 may be connected to the first one of the air tunnels 5 which then replaces the plenum conduit 15. The result would be the same since the first tunnel 5 interconnects the two channels 7.

The same reasoning applies at the terminal end 11 of the mattress where a plenum conduit 21 is provided to join the relevant ends of the channels 7. Again, the last tunnel 5, at the terminal end 11, may be used as the plenum conduit.

As best shown in FIG. 2, because of the tapering or narrowing down of the air distribution channels 7 and to keep the mattress 1 of constant width, the air tunnels may be integrally formed with small air pockets 22 (see FIG. 5) extending over and projecting laterally beyond the channels 7. An exception may be in the first tunnel 5 or so adjacent to the inlet end 9 where the tunnels extend over but not beyond the channels.

Referring now to FIGS. 2 and 3, the mattress body 3 may be made up of preformed top and bottom parts 23 and 25.

The top part 23 is obtained from a plastic sheet blank 27 having a U-shaped slots 29 formed along opposite lateral edges. To obtain a tunnel 5, the sheet 27 is folded up along an axis 30 between two successive slots 29 until the tunnel 5 is obtained, having essentially the shape of an inverted U (see FIG. 4), in cross-section, with a pair of straight spaced legs 31 and a dome-shaped bight 33. With all the tunnels 5 thus shaped, the opposed longitudinal edges of the blank 27 are then first bent down and then outwardly to form weld flanges 35. Next, the so far shaped top part 23 is applied over the lower part 25 with the lower edges of the spaced legs 31 sitting squarely over the central portion 36 (between the air distribution channels 7) and welded thereto along weld lines 37, all of equal length across the mattress body 3. The central portion 36 then serves as flat bottoms for the tunnels 5. The unconnected edges of the ends of the tunnels 5 are then brought together, as shown by the horizontal arrows in FIG. 3, and are welded to close the tunnels 5 which then communicate with the channels 7 and the plenum conduits 15 and 21. The two sheet parts 25, 27, are finally welded along their weld flanges 35, 35'.

As mentioned above, the weld lines 37 across the central portion 36 of the bottom part 25 are all of equal length. Referring to FIG. 2, in order then for the channels 7 to taper from the inlet end 15 to the terminal end 11, it is necessary that the lateral edges of the top and bottom parts 23, 25, more precisely the weld flanges 35, 35', taper in between the ends 9 and 11, as shown.

Figure 1:
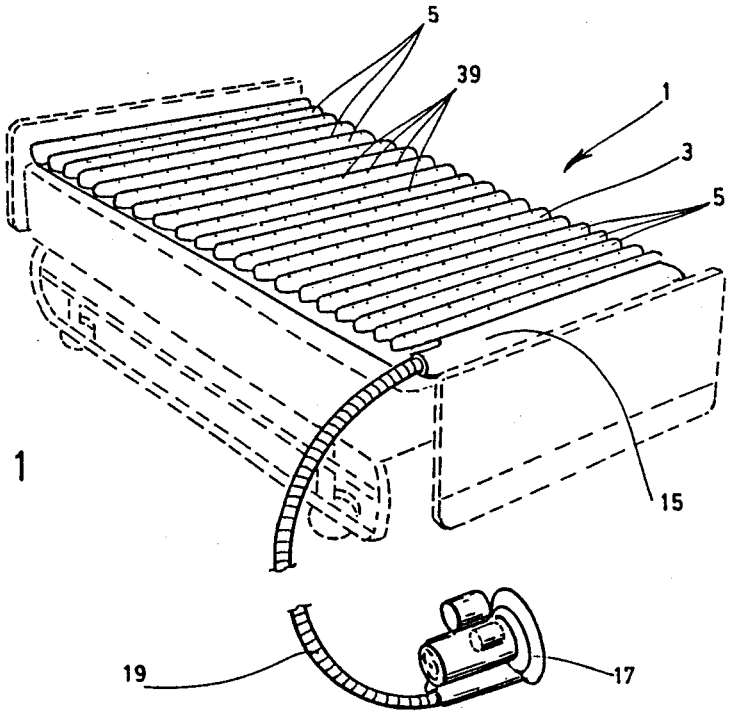
FIG. 1 is a perspective view of a mattress incorporating the of the invention.

In order to avoid contamination of the mattress by the patient, an air permeable and water imprevious sheet 37' (FIG. 2) is applied over the mattress 1. The lower surface of sheet 37 consists of an air permeable hydrophobic urethane coating. The upper surface is made of a permeable woven textile material. Air necessary to reduce or prevent maceration comes from a plurality of bleed holes 39 (FIG. 1) through the dome-shaped bights 33 of the tunnels 5.

Figure 5:
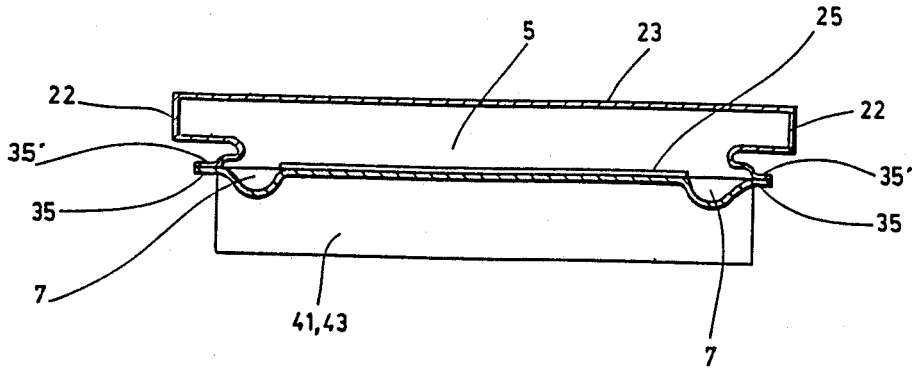
FIG. 5 is a cross-section at about midlength of the mattress.

Finally, and as illustrated in FIGS. 4 and 5, contoured end flaps 41, 43, are provided at the inlet end 9 and at the terminal end 11. They project down from the mattress bottom part 25 and extend across the ends 9, 11, as well as along a portion of the body 3 so as to tuck in the body 3 around the ends of a hospital bed mattress to firmly hold it in position thereon.

I claim:

1. An inflatable air mattress formed from a one piece elongated body having an air inlet end and a terminal end comprising:

a substantially planar lower portion having a longitudinal air distribution channel along each longitudinal side;

an upper portion comprising a plurality of straight elongated pillow-like air tunnels;

said air tunnels disposed transverse of said body adjacent to and parallel with each other;

said air tunnels being sealed from said lower portion along substantially all their length;

each of said air tunnels having an opening at each end thereof to be in fluid communication with said distribution channels;

each of said air tunnels being integrally formed with a small air pocket at each end, each said pocket extending over and covering the adjacent distribution channel, thereby to increase the width of the mattress;

an open transverse plenum conduit at an inlet end of said body, said conduit opening into said distribution channels, where by said channels, said air tunnels and said plenum conduit communicates with each other; and air pressure source means operatively connected to said transverse plenum conduit for supplying said conduit, said channels and said tunnels with pressurized inflation air.

2. The inflatable mattress according to claim 1, wherein said air tunnels each have outer walls transverse of the body, so that adjacent air tunnels have separate outer walls.

3. The inflatable mattress according to claim 2, wherein the distribution channels taper from said inlet end to said terminal end.

4. An air mattress as claimed in claim 1, wherein said air pressure source means comprise:

a pressure-adjustable compressor assembly, and an air inlet conduit having one end connected to said compressor assembly and another end connected to said plenum conduit; said air-inlet conduit being devoid of air-flow control devices.

5. An air mattress as claimed in claim 4, wherein said air tunnels are of equal size.

6. An air mattress as claimed in claim 5, wherein each air tunnel has, over the major portion thereof, an inverted U-shape, in cross-section, with pair of straight legs, a dome-shaped bight at the top and a flat bottom.

7. An air mattress as claimed in claim 6, wherein said dome-shaped bight is perforated with air bleed holes.

8. An air mattress as claimed in claim 1, further comprising contoured end flaps at said inlet end and at said terminal end, said flaps projecting down from said body at said ends and along a portion of the sides of said body for tucking in said body around the ends of a bed mattress.

* * * * *